US005117939A

United States Patent [19]

Noguchi et al.

[11] Patent Number: 5,117,939

[45] Date of Patent: Jun. 2, 1992

[54] SOUND ATTENUATOR

[75] Inventors: Yoshihiro Noguchi; Toshihisa Imai; Yutaka Takahashi, all of Saitama; Ken Morinushi; Hideharu Tanaka, both of Hyogo, all of Japan

[73] Assignees: Mitsubishi Electric Home Appliance Co., Ltd., Saitama; Mitsubishi Denki Kabushiki Kaisha, Tokyo, both of Japan

[21] Appl. No.: 551,361

[22] Filed: Jul. 12, 1990

[30] Foreign Application Priority Data

Aug. 8, 1989 [JP] Japan ..... 1-205273

[51] Int. Cl.[5] ..... E04F 17/04

[52] U.S. Cl. ..... 181/224

[58] Field of Search ..... 181/224, 233, 241, 255, 181/264, 268, 269

[56] References Cited

U.S. PATENT DOCUMENTS

| | | | |
|---|---|---|---|
| 2,740,616 | 4/1956 | Walden | 181/264 X |
| 3,018,840 | 1/1962 | Bourne et al. | 181/224 |
| 3,033,307 | 5/1962 | Sanders et al. | 181/224 |
| 4,167,986 | 9/1979 | Conway | 181/224 |
| 4,287,962 | 9/1981 | Ingard et al. | 181/224 |
| 4,362,223 | 12/1982 | Meier | 181/224 X |

FOREIGN PATENT DOCUMENTS

| | | | |
|---|---|---|---|
| 715865 | 8/1968 | Canada | 181/224 |

*Primary Examiner*—Brian W. Brown

*Attorney, Agent, or Firm*—Rothwell, Figg, Ernst & Kurz

[57] ABSTRACT

A sound attenuator has at least one sound absorber composed of a hollow body of a hard porous material and an outer or inner layer of air, and exhibits good sound-absorbing property even in a low frequency range, even if the hollow body has a small wall thickness. The hollow body may be provided with projections or a semicircular or otherwise shaped part or parts, or both, serving to maintain the outer or inner layer of air in proper shape. The device is inexpensive and yet is very reliable in quality. When the device is long, the projections in linear form are particularly useful for restraining any flanking transmission of noise and thereby enabling the device to achieve a higher rate of attenuation per unit length. The sound-absorbing property of the device can be controlled over a wide range of frequencies if the hollow body has a porosity varying continuously in a specific direction. The device exhibits an improved sound-absorbing property particularly in a low frequency range if the hollow body is provided with a skin layer on its wall surface facing an air passage.

10 Claims, 7 Drawing Sheets

SOUND ATTENUATOR

BACKGROUND OF THE INVENTION

1. Field of the Invention

This invention relates to a sound attenuator provided in an air passage for reducing the noise generated by a blower, air conditioner, or the like, and including a special porous structure.

2. Description of the Prior Art

A known sound attenuator of the type to which this invention pertains is shown by way of example in FIGS. 1 and 2 and which is disclosed in Japanese Utility Model Publication No. 33898/1985. This device is intended for use in a vacuum cleaner and comprises a cylindrical duct 1, an inner cylinder 2 formed from a nonwoven fabric and having a wall thickness of 0.1 to several millimeters, and a sound-absorbing material 3, such as felt or glass wool, filling the annular space between the duct 1 and the inner cylinder 2. The inner cylinder 2 and the sound-absorbing material 3 cooperate to define a sound absorber. The device is fitted by connectors 4 to an appropriate portion of the air passage of the vacuum cleaner. The inner cylinder 2 has a smooth inner surface formed by treatment with heat or a resin.

This is a typical example of known sound attenuators which can be incorporated in the air passage of a blower, air conditioner, air or vacuum cleaner, or the like for reducing the noise which is thereby generated. In the specific device as hereinabove described, the sound-absorbing material 3 having an indefinite shape is held by and between the duct 1 and the inner cylinder 2 formed from a nonwoven fabric. Sound waves are transmitted through cylinder 2 and are absorbed by material 3. And the inner cylinder 2 has a smoothed inner surface to prevent any fluffing that would otherwise be unavoidable as a drawback of the nonwoven fabric and result in the gathering of dust or dirt by its inner surface, leading eventually to the blocking of the air passage.

The known device has, however, a number of drawbacks. It comprises as many as three components, i.e., the duct 1, the inner cylinder 2 and the sound-absorbing material 3. Its fabrication calls for a fairly complicated process including the step of forming a smooth inner surface on the inner cylinder 2 and the step of incorporating the sound-absorbing material 3 having an indefinite shape. Therefore, the device is considerably expensive to manufacture and yet there is no assurance of all of the products being always of the same reliable quality.

When it is necessary to make a device which can attenuate even sound having a rather low frequency, it is necessary to form the sound-absorbing material 3 with a considerably large thickness, or provide a layer of air between the duct 1 and the sound-absorbing material 3. This necessarily adds to the cost of manufacture and the variation of quality. The sound-absorbing material 3 has a substantially uniform specific density. As it has an indefinite shape, it is difficult to dispose in a way giving it the optimum specific gravity distribution enabling it to exhibit good sound-absorbing properties or to form it into a body having a complicated shape.

Another drawback of the known device is the phenomenon called flanking transmission. Although the device can be elongated to achieve a higher rate of attenuation, its elongation beyond a certain limit brings about a sharp drop in its attenuation rate per unit length, since the noise caused by the propagation of vibration through the sound-absorbing material 3 becomes predominant and is transmitted to the exit of the device without being substantially attenuated. This phenomenon is discussed in detail by William F. Kerka in his paper entitled "Attenuation of Sound in Lined Ducts With and Without Air Flow", ASHRAE JOURNAL, Mar. 1963.

SUMMARY OF THE INVENTION

In view of the drawbacks of the prior art as hereinabove pointed out, it is an object of this invention to provide a sound attenuator which includes a sound absorber having a simple construction and retaining a desired shape, while exhibiting good sound absorbing properties even in a relatively low frequency range, which is inexpensive to manufacture, and which can always be reproduced without variance in quality.

It is another object of this invention to provide a sound attenuator which can be elongated to a considerable length to achieve a higher rate of attenuation without having any sharp drop in its attenuation rate per unit length.

It is still another object of this invention to provide a sound attenuator which exhibits higher sound-absorbing properties than can be attained by any known sound-absorbing material having a uniform specific gravity, and good sound-absorbing properties in a wider frequency range.

These objects are essentially attained by a sound attenuator comprising a sound absorber which includes: a first porous structure of a hard material in the form of a hollow porous body as an attenuator and having an air passage therethrough, and a plurality of projections formed integrally on the outer wall surface of the porous body, the porous structure being disposed coaxially within a duct, and an outer layer of air formed between the outer wall surface of the porous body and the inner wall surface of the duct between which the projections serve as spacers.

The projections may include at least one projection extending about the whole circumference of the porous body and having a shape which is substantially identical to the cross-sectional shape of the air layer as taken at right angles to the longitudinal axis of the air passage.

The attenuator may further comprise a second porous structure of a hard material which comprises a hollow cylindrical porous body positioned coaxially within the duct and having at least one end closed by a generally semispherical or conical air guide cover.

According to another aspect of this invention, there is provided a sound attenuator of the splitter type for use in a rectangular duct having a cross section divided into a plurality of portions along its width or height, which comprises at least one sound absorber disposed respectively at each portion, composed of a hollow porous structure of a hard material, an inner layer of air therein, and each end of which is closed by a generally semicircular or triangular air guide cover forming an integral part of the porous structure. The porous structure is preferably provided with at least a pair of linear projections lying at right angles to the longitudinal axis of an attenuator air passage, each formed integrally on one of the opposite inner wall surfaces of the porous structure.

As the sound absorber includes the hollow porous structure having a porous wall and the outer or inner layer of air, it exhibits good sound-absorbing properties even in a relatively low frequency range, even if it may have a small wall thickness. Moreover, the porous structure of a hard material, the projections and semicircular or otherwise shaped covers formed integrally as an integral part maintain the outer or inner layer of air in definite dimensions as desired. Therefore, the device of this invention can be manufactured at a very low cost and can always be reproduced without variance in quality, e.g., dimensions and sound-absorbing properties.

The linear projections as hereinabove described enable the attenuation of the noise caused by the propagation of vibration along the porous structure and thereby ensure that the device achieves a satisfactorily high rate of attenuation per unit length, even if it may be considerably long.

The device exhibits a still better sound-absorbing performance if the porous body has a specific gravity varying continuously along its wall thickness or plane. Its performance in a low frequency range can still be improved if the porous body is provided with a skin layer having a thickness not exceeding 100 microns on its wall surface facing the air passage.

These and other objects, features and advantages of this invention will become more apparent from the following description and the accompanying drawings.

DESCRIPTION OF THE PREFERRED EMBODIMENTS

Figure 1:
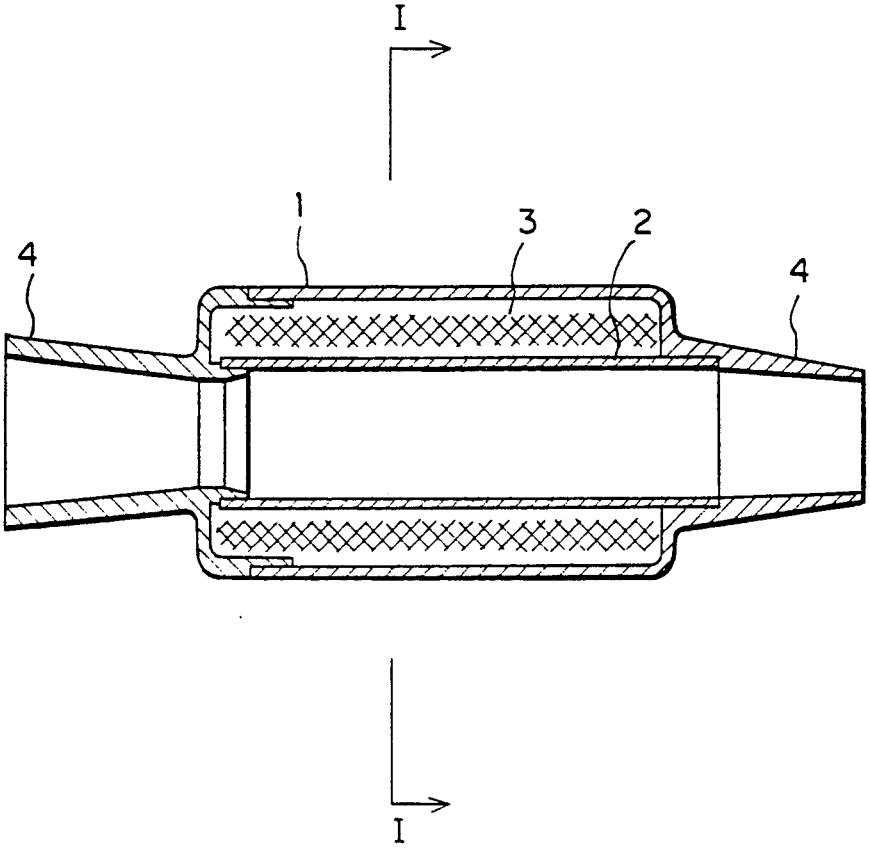
FIG. 1 (PRIOR ART)
FIG. 1 is a longitudinal sectional view of a prior art sound attenuator.
Figure 2:
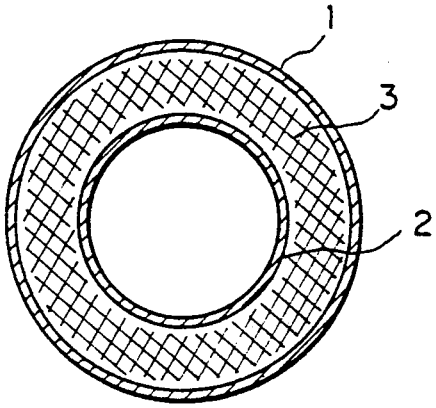
FIG. 2 (PRIOR ART)
FIG. 2 is a transverse sectional view taken along the line I—I of FIG. 1.
Figure 3:
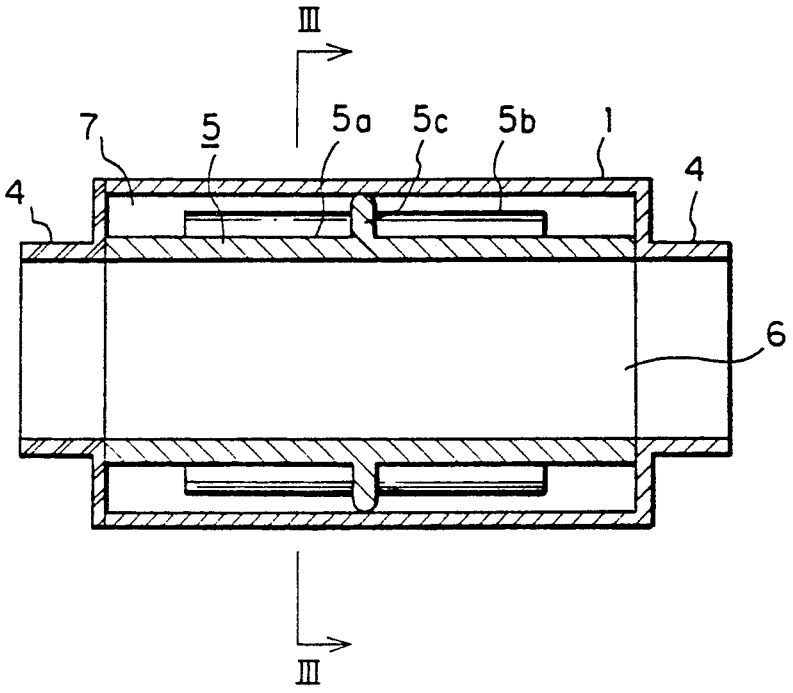
FIG. 3 is a longitudinal sectional view of a sound attenuator embodying this invention.
Figure 4:
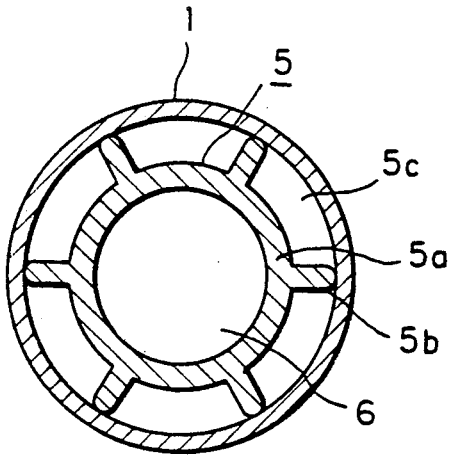
FIG. 4 is a transverse sectional view taken along the line III—III of FIG. 3.

A sound attenuator embodying this invention is shown in FIGS. 3 and 4, and includes a duct 1 and connectors 4 which are basically identical to their counterparts in the known device as hereinbefore described. A salient feature of the device according to this invention resides in a hollow porous structure 5 formed from a hard, but porous material. The porous structure 5 comprises a hollow cylindrical porous body 5*a* disposed in the duct 1 coaxially therewith and defining an attenuator air passage 6 therethrough. The porous body 5*a* is provided on its outer peripheral surface with a plurality of radially outwardly extending projections 5*b* each forming an integral part of the porous body 5*a*. The projections 5*b* serve as spacers for holding the porous body 5*a* in an appropriately spaced apart relation from the inner wall surface of the duct 1 and thereby maintaining an outer air layer 7 between the outer wall surface of the porous body 5*a* and the inner wall surface of the duct 1. The projections 5*b* include one circumferentially extending projection 5*c* which extends about the whole circumference of the porous body 5*a* in the midportion of the duct 1 and has a shape which is substantially equal to the cross-sectional shape of the air layer 7 as taken at right angles to the longitudinal axis of the air passage 6. The porous body 5*a* and the air layer 7 define a sound absorber.

The sound absorber, therefore, exhibits good sound-absorbing properties even in a relatively low frequency range, even if the porous body 5*a* may have a relatively small wall thickness. Moreover, the porous body 5*a* formed from a hard material and the projections 5*b* and 5*c* of the same material maintain the air layer 7 in accurate and definite dimensions. Therefore, the device of this invention can be manufactured at a very low cost and can, moreover, be reproduced any number of time without changing in quality, e.g., dimensions and sound-absorbing property.

Figure 5:
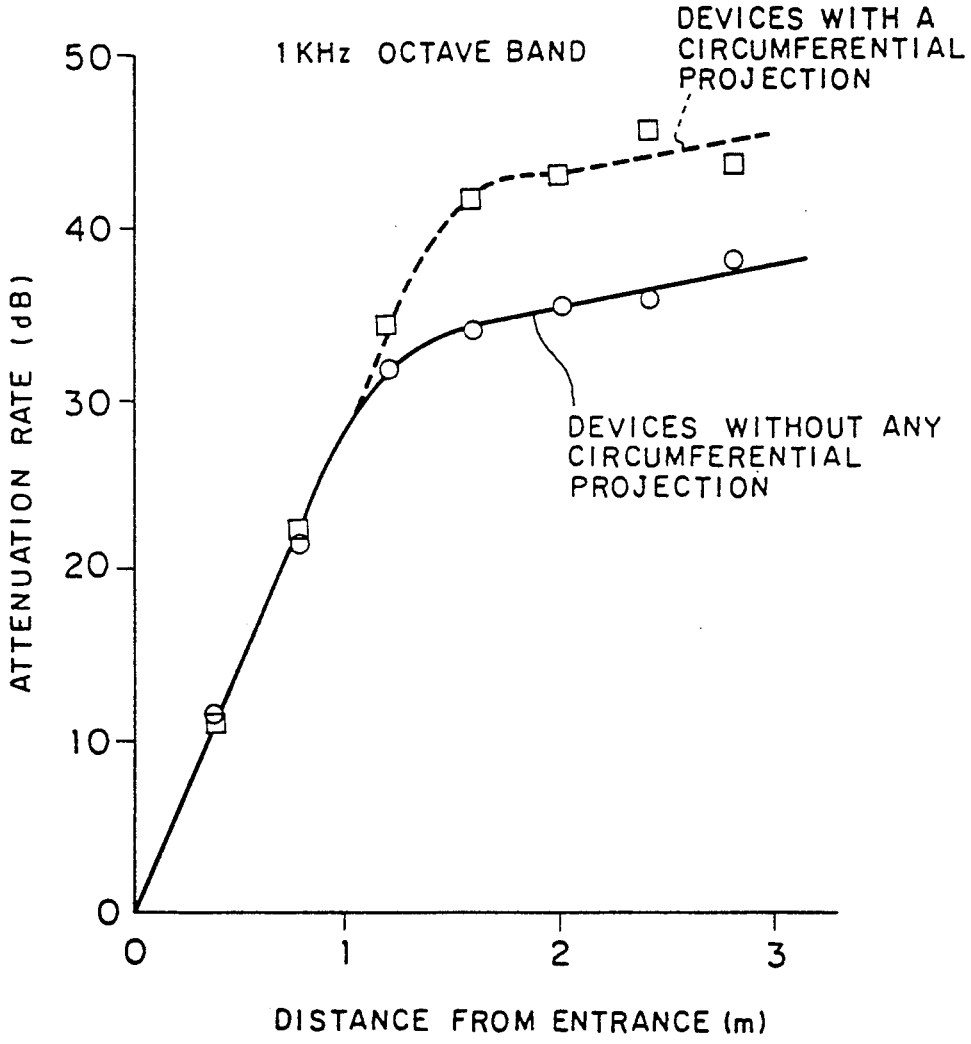
FIG. 5 is a graph showing the attenuation rates of sound attenuators with and without a circumferential projection in relation to their increase in length.

The flanking transmission of noise by the propagation of vibration along the porous structure 5 is significantly reduced at the circumferential projection 5*c*, since the characteristics which the propagation of vibration along the structure 5 exhibits undergo so great a change at the projection 5*c* that no substantial vibration is thereafter transmitted. Therefore, the device according to this invention can be effectively elongated to achieve a significantly improved result of attenuation, as it can maintain a sufficiently high attenuation rate per unit length. FIG. 5 shows the results of a series of experiments which were conducted to compare the attenuation rates of devices each having a circumferential projection and devices not having any circumferential projection. The devices of each of the two groups had a different length from one another, and each device of one group was of the same length with one device of the other group. The circumferential projection manifested its effect in every device having a length of about 1 m or more and added as much as a maximum of about 8 dB to the result of attenuation by any device having no circumferential projection, as is obvious from FIG. 5.

It is possible to realize a still longer device exhibiting a sufficiently high attenuation rate per unit length for achieving a still better result of attenuation, if its circumferential projection 5*c* is formed with so high a specific gravity that it may be impermeable to air, or if it is provided with more than one circumferential projection. It is not always necessary to provide any circumferential projection in a short device which is not required to exhibit a very high rate of attenuation, but it may be sufficient to provide any such device with a plurality of small projections occurring in spots, or linear projections lying in parallel to the direction of air flow.

Figure 6:
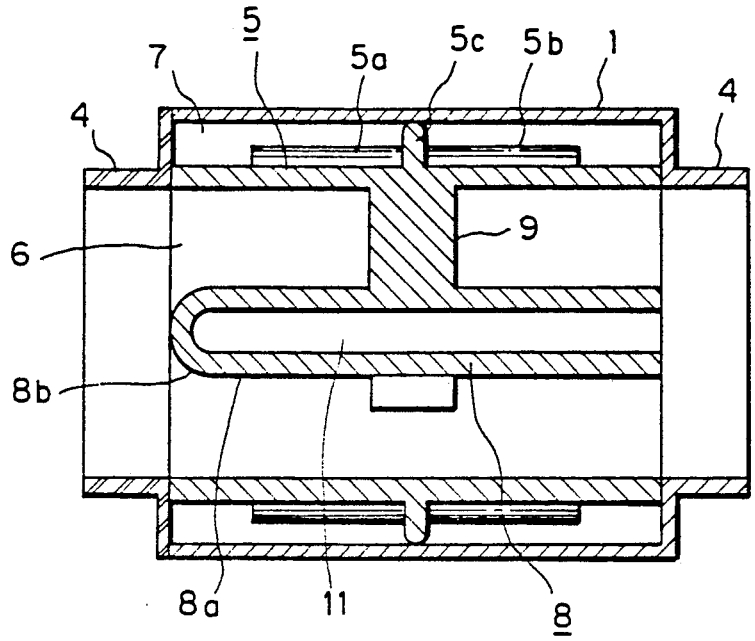
FIG. 6 is a longitudinal sectional view of a sound attenuator according to another embodiment of this invention.

Reference is now made to FIG. 6 showing a device according to another embodiment of this invention. The device is particularly intended for use in a duct 1 having a large diameter. It includes a first hollow porous structure 5 which is substantially identical to the structure 5 shown in FIGS. 3 and 4, and a second hollow porous structure 8 formed from a hard porous material and disposed in the first porous structure 5 coaxially with it and the duct 1. The second porous structure 8 is provided for making up any insufficiency of the attenuation which can be achieved by the device of FIGS. 3 and 4 having only a sound absorber located along the inner wall surface of the duct 1. The structure 8 comprises a hollow cylindrical porous body 8*a* having one end closed by an air guide cover 8*b* forming an integral part of the porous body 8*a*. The cover 8*b* has a generally semispherical or conical shape and is provided at that end of the porous body 8*a* which is located at the upstream end of the device, for allowing air to flow smoothly into an attenuator air passage 6.

The second porous structure 8 is so sized as to reduce the cross-sectional area of the air passage 6 to about a half, and thereby makes it possible to achieve an about twice higher rate of attenuation. The structure 8 defines an inner air layer 11 therein, while the first porous structure 5 defines an outer air layer 7. The structure 8 is also formed from a hard material and has a small wall thickness. Therefore, the device as a whole can be manufactured at a very low cost and can always be reproduced without variation in quality, e.g., dimensions and sound-absorbing property.

The second porous structure 8 is connected to the first porous structure 5 by a plurality of connecting legs 9 and is thereby held coaxially with the duct 1. Each leg 9 can be formed as an integral part of both of the structures 5 and 8 as shown in FIG. 6, though it may alternatively be formed as a separate part from one or both of the structures 5 and 8.

Although both of the devices shown in FIGS. 3 and 4 and FIG. 6 are used in a round duct 1, it is needless to say that the device of this invention is equally effective when used with a differently shaped duct, such as one having a square, rectangular or oval cross section. Although the circumferential projection 5*c* has been shown as having an outside diameter which is equal to the inside diameter of the duct 1, no particular problem arises from any circumferential projection having, except at a plurality of edge portions, an outside diameter which is slightly smaller than the inside diameter of the duct 1, so that the porous structure 5 may be easier to insert into the duct 1.

Figure 7:
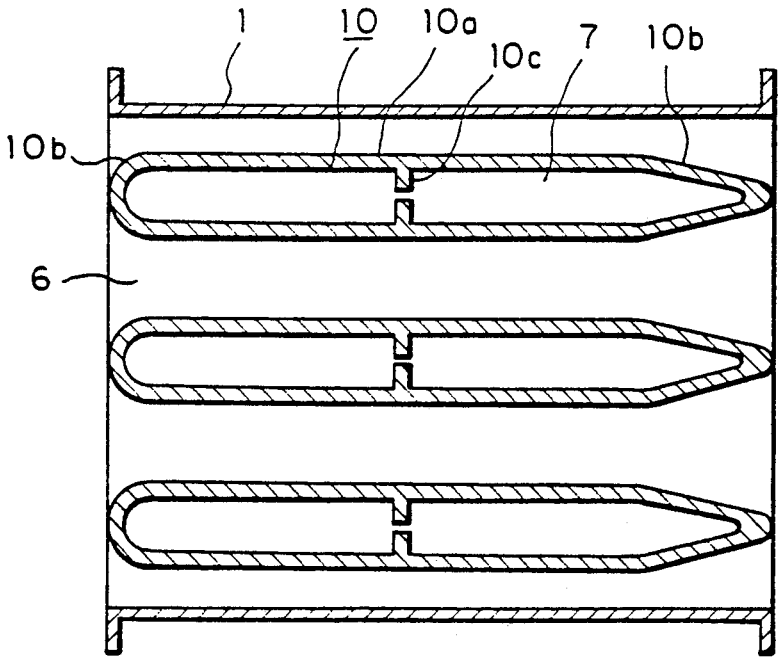
FIG. 7 is a longitudinal sectional view of a sound attenuator according to still another of this invention.

Attention is now drawn to FIG. 7 showing a splitter type device according to still another embodiment of this invention. The device is particularly suitable for use in a duct 1 having a considerably large cross-sectional area. The duct 1 has a rectangular cross section which is divided into a plurality of portions along its width or height. Each cross-sectional portion of the duct 1 is provided with a sound absorber. The sound absorber is defined by a hollow porous structure 10 formed from a hard porous material and comprising a hollow porous body 10*a* defining an inner air layer 7 therein. The porous body 10*a* has each end closed by an air guide cover 10*b* having a generally semicircular or triangular shape. The covers 10*b* enable a smooth flow of air at both ends of an attenuator air passage 6 and also hold the porous body 10*a* and the inner air layer 7 in proper shape.

Each porous body 10*a* is provided with a pair of integrally formed linear projections 10*c* on the opposite inner wall surfaces thereof, respectively. The projections 10*c* lie at right angles to the direction of air flow through the air passage 6 and contribute to reducing the flanking transmission of noise along the porous body 10*a*.

The device of FIG. 7 also can be manufactured at a very low cost and can always be reproduced without variation in quality, e.g., dimensions and sound-absorbing property. Moreover, it can be elongated without showing any undesirable drop in the rate of attenuation.

Although the linear projections 10*c* have been shown as existing in a pair, it is equally effective to provide a single projection as in the form of a strip obtained by joining the two linear projections 10*c*. It is possible to realize a still longer device maintaining a sufficiently high attenuation rate per unit length for achieving a still better result of attenuation if each projection 10*c* is formed with so high a specific gravity that it may be impermeable to air, or if a greater number of projections are provided. No linear projection 10*c*, however, need be provided in a short device which is not required to exhibit a very high rate of attenuation.

Although the porous structures 10 have been described as being provided only in the split cross-sectional portions of the duct 1, the device may further include an additional porous structure or structures disposed along the inner wall surface of the duct 1. The additional porous structures may have a shape which is similar to a half of any structure 10 shown in FIG. 7, or may be similar to the structure 5 shown in FIG. 4, but have a rectangular cross section. Although no means for securing the porous structures 10 to the duct 1 has been shown, it is sufficient to employ any ordinary means, such as bonding or screwing the structures 10 to small frames provided on the inner wall surface of the duct 1, or passing screws through the wall of the duct 1 into threaded holes made in the walls of the structures 10.

It is possible to obtain a device having a still higher level of sound-absorbing property by modifying the porous body 5*a*, 8*a* or 10*a* in any of the devices which have hereinabove been described. More specifically, it is effective to form each porous body with a specific gravity varying continuously along its wall thickness or plane. It is also effective to provide a skin layer having a thickness not exceeding 100 microns on that wall surface of each porous body which faces the air passage 6. For further details, reference is made to our prior U.S. patent application Ser. No. 07/429,496 entitled "Porous Structure". The following description is based on the disclosure of our prior application.

Figure 8:
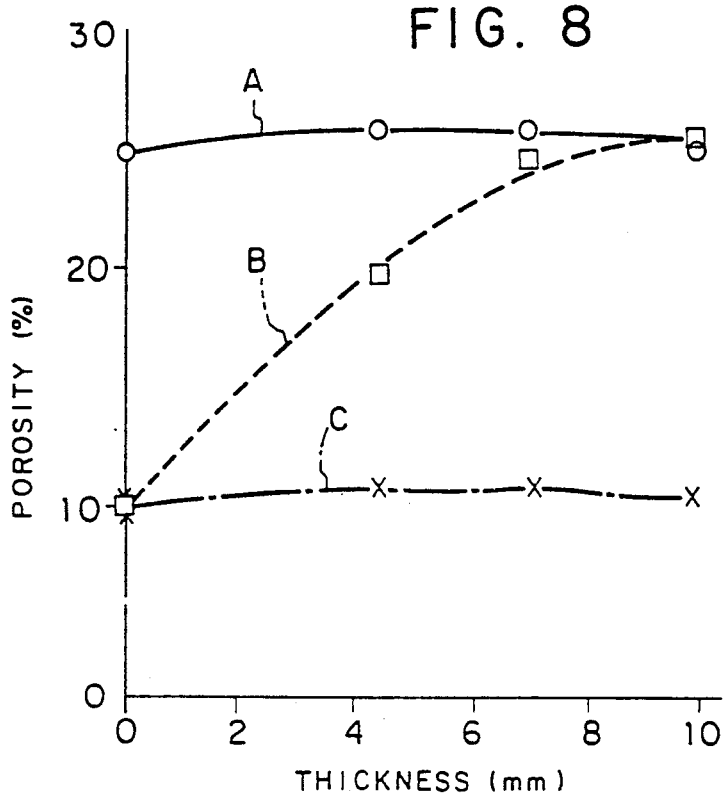
FIG. 8 is a graph showing the porosity (i.e., specific gravity) of a porous body varying along its wall thickness, as well as the porosity of two other samples remaining substantially equal along their wall thickness.
Figure 9:
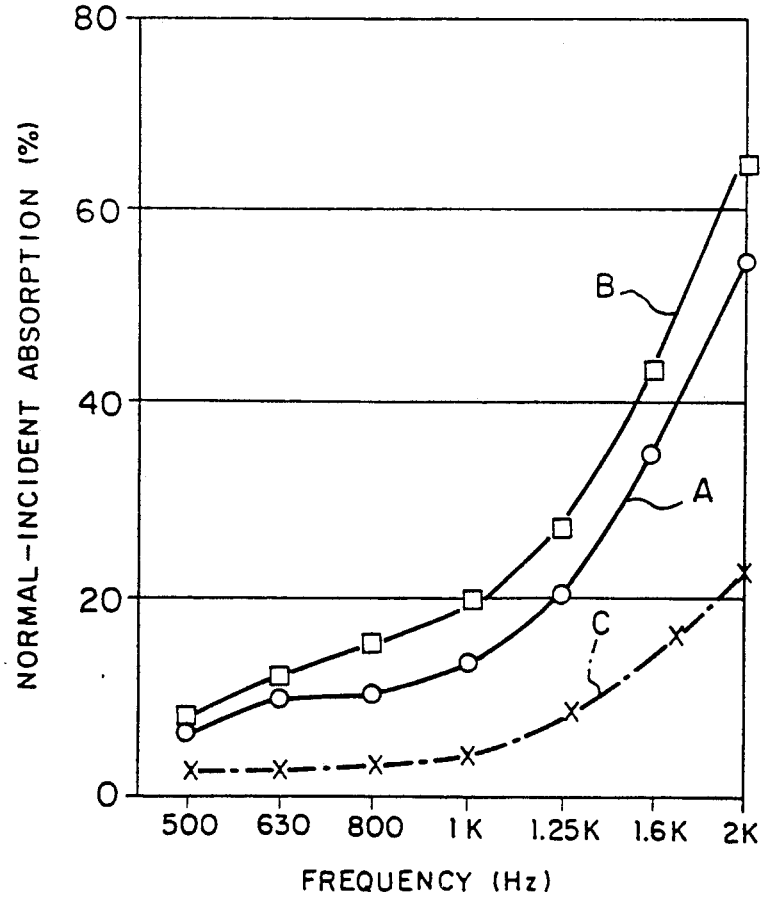
FIG. 9 is a graph showing the normal-incident sound absorption coefficient of each of the porous bodies having the porosity distributions shown in FIG. 8.

Attention is directed to FIGS. 8 and 9 of the accompanying drawings. FIG. 8 shown the porosity (i.e., specific gravity) distributions of three samples of porous bodies across their wall having a thickness of 10 mm. The two samples represented by Curves A and C, respectively, have a substantially uniform porosity of about 25% and about 10%, respectively, along their wall thickness, but the sample represented by Curve B has a porosity of 10 to 25% varying continuously across its wall thickness. FIG. 9 shows the normal-incident sound absorption coefficient of each of the three samples. As is obvious from Curve B in FIG. 9, the sample having a varying porosity exhibited the highest sound absorption coefficient of all over the frequency range involved.

Figure 10:
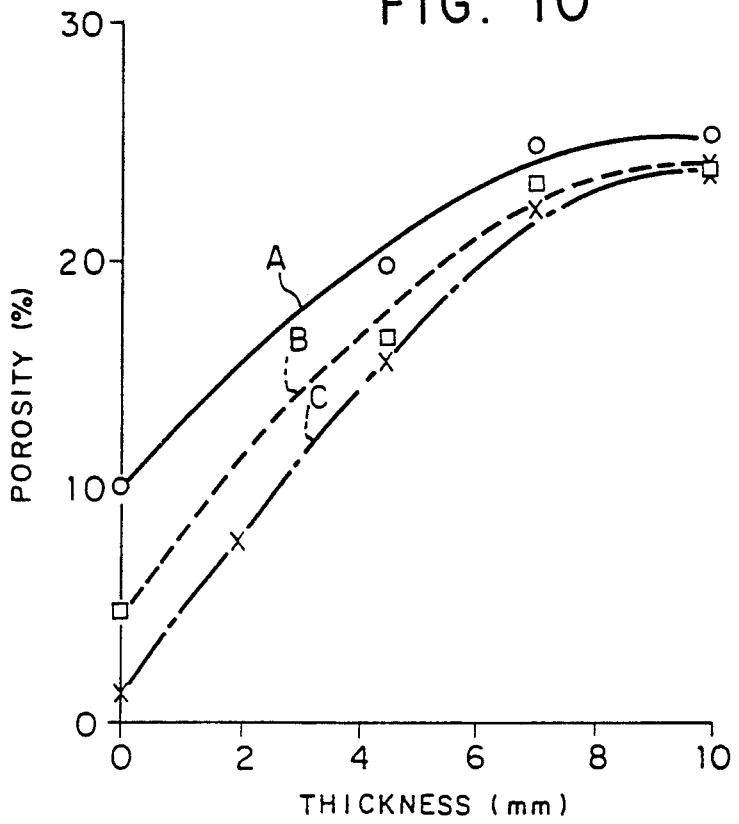
FIG. 10 is a graph showing the porosity of each of three samples of porous bodies varying along its wall plane in relation to its wall thickness.
Figure 11:
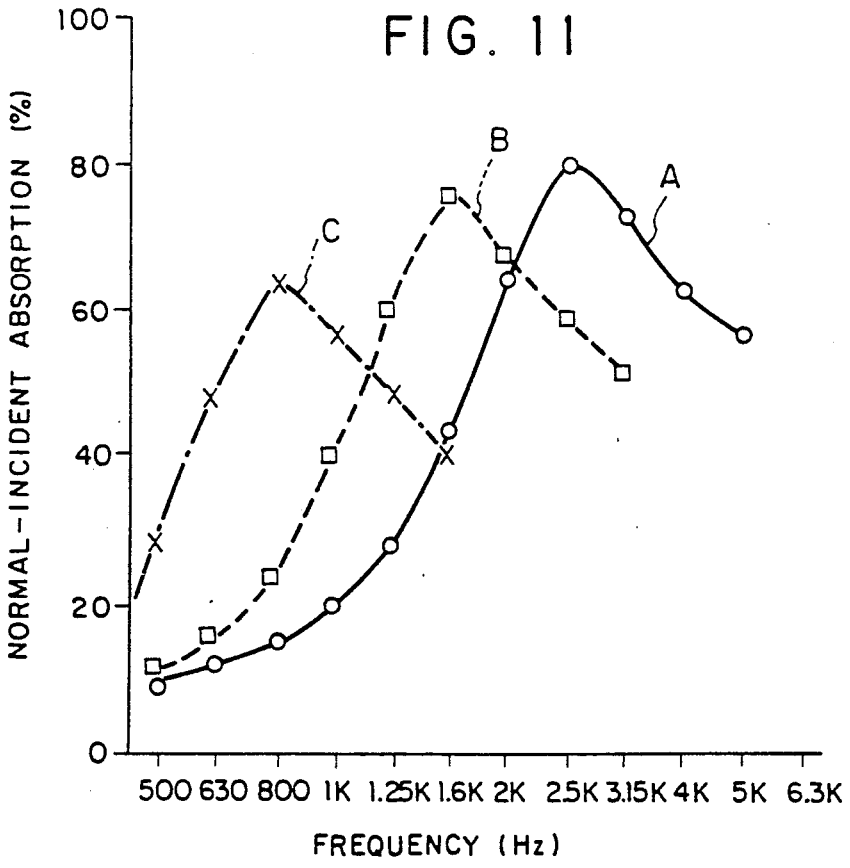
FIG. 11 is a graph showing the normal-incident sound absorption coefficient of each of the samples having the porosity distributions shown in FIG. 10.

Attention is now directed to FIGS. 10 and 11. FIG. 10 shows the porosity of each of three samples of porous bodies varying along its wall plane, and its porosity distribution across its wall having a thickness of 10 mm. FIG. 11 shows the sound absorption characteristics which the three samples exhibited. It is obvious from FIG. 11 that a porous body having a particularly low porosity at and near the sound-incident surface of its wall, as shown by Curve C in FIG. 10, exhibits an improved sound absorption in the low frequency range, and that a device including a porous body having a porosity varying along its wall plane exhibits a good sound-absorbing property in a wider range of frequencies.

Figure 12:
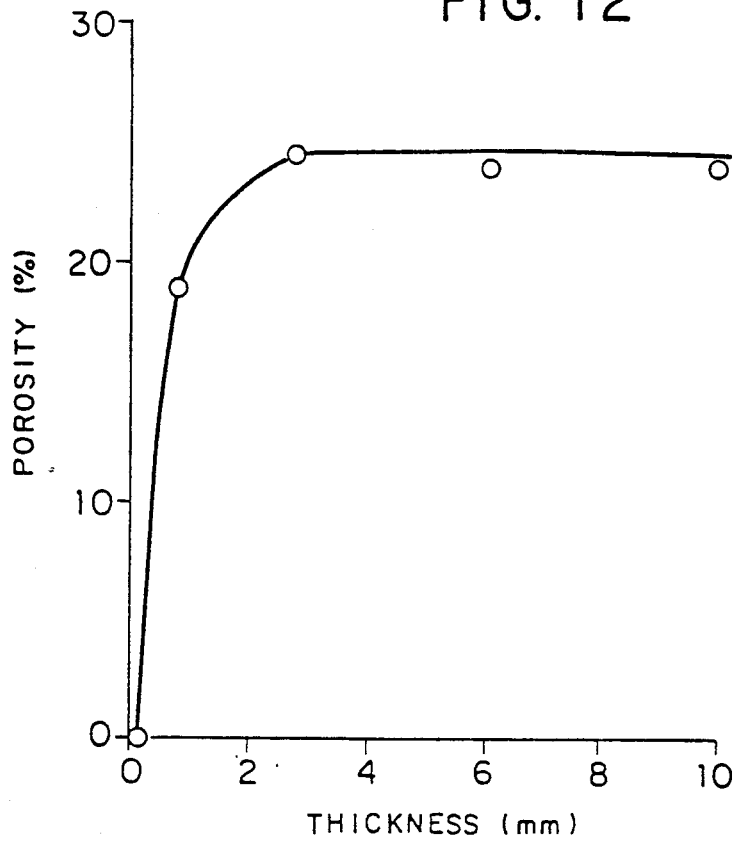
FIG. 12 is a graph showing the porosity of a porous body having a skin layer in relation to its wall thickness.
Figure 13:
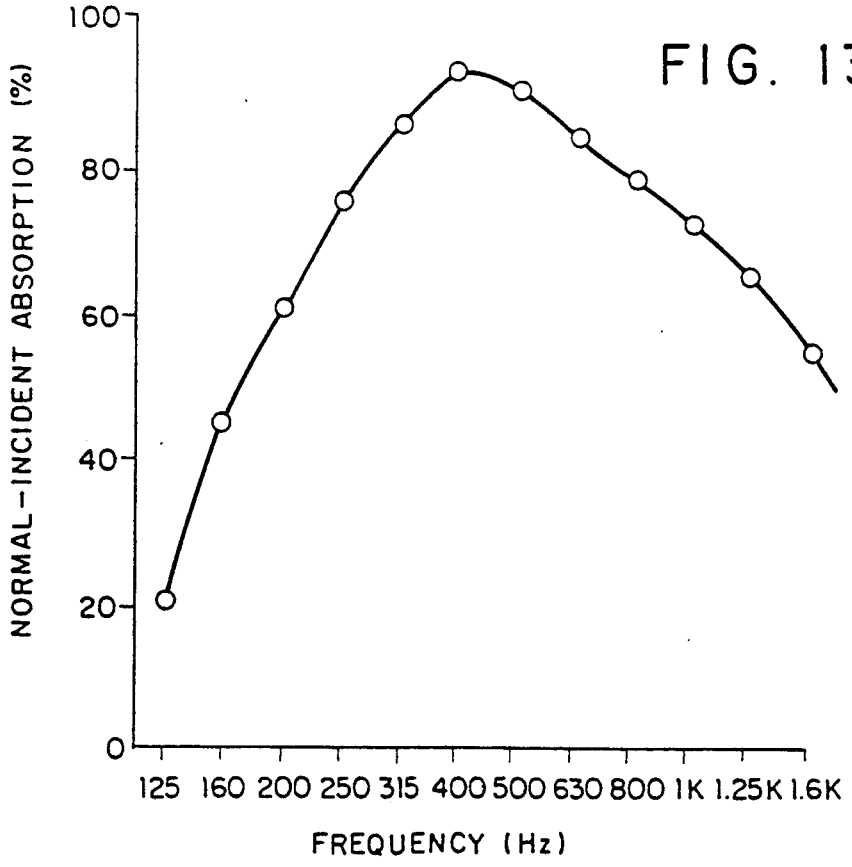
FIG. 13 is a graph showing the normal-incident sound absorption coefficient of the porous body having the porosity distribution shown in FIG. 12.

Attention is finally drawn to FIGS. 12 and 13. FIG. 12 shown the porosity distribution across the wall of a sample of porous body having a thickness of 10 mm, and FIG. 13 shows the normal-incident sound absorption coefficient which it exhibited. As is obvious from FIG. 13, the maximum absorption was exhibited at a frequency which was as low as 400 Hz, and its maximum absorption was even over 90%. A microscopic examination was made of the cross section of the low-porosity portion of the sample at and near the sound-incident surface of its wall, and revealed the presence of a substantially air-impermeable skin layer having a thickness of about 30 microns on its surface. A variety of samples having different skin layer thicknesses were tested for sound absorption. No expected result was obtained from any sample having a skin layer thickness exceeding 100 microns, but it showed its maximum absorption only at a higher frequency than that at which any sample having a skin layer thickness not exceeding 100 microns exhibited its maximum absorption. Therefore, the appropriate thickness of any skin layer in the context of this invention does not exceed 100 microns.

What is claimed is:

1. A sound attenuator comprising:

a duct;

a first porous structure of a hard material in the form of a hollow porous body having an attenuator air passage therein, and a plurality of elongated projections each of which is integrally formed along the length of an outer wall of said body, said body being disposed in a predetermined position along an inner wall of said duct through contact of said plurality of elongated projections with said inner wall; and a static air layer formed between said outer wall of said body and said inner wall of said duct.

2. A sound attenuator as set forth in claim 1, further comprising at least one integral projection extending about an entire circumference of said outer wall of said body and has a shape which is substantially identical to a cross-sectional shape of said air layer as taken at right angles to a longitudinal axis of said air passage.

3. A sound attenuator as set forth in claim 1 or 2, wherein said sound attenuator further includes a second porous structure in the form of a hollow body coaxially disposed within said first porous structure in said duct, and having at least one end thereof closed by a generally semi-spherical or conical shaped air guide cover.

4. A splitter sound attenuator for a rectangular duct air passage, the cross section of which is divided into portions along one dimension thereof, said splitter sound attenuator comprising:

a plurality of sound absorbers each disposed in said portions respectively, each of said sound absorbers composed of a hollow body having a pair of walls of a hard porous material spaced apart from each other to form a static inner air layer therebetween, and air guide covers in a generally semicircular or triangular shape, each integrally formed and smoothly joined with both walls of said body respectively, for defining both ends of said static inner air layer.

5. A sound attenuator as set forth in claim 4, wherein said hollow body is provided with at least a pair of linear projections extending at right angles to a longitudinal axis of said air passage, each of said projections being integrally formed on the inner surface of one of said walls.

6. A sound attenuator as set forth in any of claims 1, 2, 4, or 5, wherein said hollow body has a porosity varying continuously along a wall thickness or plane thereof.

7. A sound attenuator as set forth in any of claims 1, 2, 4, or 5, wherein said hollow body is provided with a skin layer having a thickness not exceeding 100 microns as an integral part of a wall surface facing said air passage.

8. A sound attenuator as set forth in claim 3, wherein said hollow body has a porosity varying continuously along a wall thickness or plane thereof.

9. A sound attenuator as set forth in claim 3, wherein said hollow body is provided with a skin layer having a thickness not exceeding 100 microns as an integral part of a wall surface facing said air passage.

10. A sound attenuator as set forth in claim 6, wherein said hollow body is provided with a skin layer having a thickness not exceeding 100 microns as an integral part of a wall surface facing said air passage.

* * * * *

UNITED STATES PATENT AND TRADEMARK OFFICE

CERTIFICATE OF CORRECTION

PATENT NO. : 5,117,939

DATED : June 2, 1992

INVENTOR(S) : Yoshihiro Noguchi, et al

It is certified that error appears in the above-identified patent and that said Letters Patent is hereby corrected as shown below:

Column 1, line 35, "And the" should be --The--.
line 62, after "properties" insert a comma --,--;

Column 2, line 33, after "material" insert a comma --,--;
line 38, after "duct" delete the comma "," and insert a semicolon --;--.

Column 3, line 43, after "another" insert --embodiment--.

Column 4, line 32, "time" should be --times--.

Column 6, line 57, "shown" should be --shows--.

Column 7, line 18, "shown" should be --shows--.

Signed and Sealed this

Twenty-first Day of September, 1993

Bruce Lehman

*Attest:*

BRUCE LEHMAN

*Attesting Officer*

*Commissioner of Patents and Trademarks*